United States Patent [19]

Crysdale

[11] 4,297,762

[45] Nov. 3, 1981

[54] PAINT TRAY AND RESERVOIR

[75] Inventor: Donald T. Crysdale, Milwaukee, Wis.

[73] Assignee: E Z Paintr Corporation, Milwaukee, Wis.

[21] Appl. No.: 79,311

[22] Filed: Sep. 27, 1979

[51] Int. Cl.[3] ..... B44D 3/12

[52] U.S. Cl. ..... 15/257.06; 222/424.5

[58] Field of Search ..... 15/257.05, 257.06, 257.07, 15/257.076, 264; 222/424.5; 220/20, 22, 90; 206/557; D9/2

[56] References Cited

U.S. PATENT DOCUMENTS

| | | | |
|---|---|---|---|
| D. 193,382 | 8/1962 | Goetz | 15/257.06 |
| 2,402,346 | 6/1946 | Rosenlund | 15/257.06 |
| 3,110,921 | 11/1963 | Conner | 15/257.06 |
| 3,590,416 | 7/1971 | Henningsen | 15/257.06 |
| 3,591,299 | 7/1971 | Pharris | 15/257.06 X |
| 3,940,824 | 3/1976 | Gioia et al. | 15/257.06 |
| 4,205,411 | 6/1980 | Cupp | 15/257.06 |

FOREIGN PATENT DOCUMENTS

| | | | |
|---|---|---|---|
| 218030 | 10/1958 | Australia | 15/257.06 |

*Primary Examiner*—Edward L. Roberts
*Attorney, Agent, or Firm*—Mason, Kolehmainen, Rathburn & Wyss

[57] ABSTRACT

This invention relates to an improved apparatus for storing and dispensing liquid such as paint. The apparatus of the invention includes a receptacle having a reservoir for receiving and containing a substantial supply of liquid and a tray for receiving and holding a relatively thin layer of liquid. The reservoir and the tray are readily accessible to manual applicator tools such as paint rollers and pads through an opening at the top. External wall portions of the receptacle include a primary base generally parallel to the tray and serving to support the receptacle in a first operative position with the tray disposed horizontally above the primary base and above the level of the liquid in the reservoir. The receptacle also has an auxiliary base provided at least in part by external wall portions capable of supporting the receptacle securely in a second operative position in which a portion of the tray may be lowered below the level of the liquid in the reservoir. Upon return of the receptacle to its first operative position a portion of the liquid is retained on the tray while any liquid in excess of the desired and predetermined quantity drains into the reservoir through suitable channels and slots provided in a wall or rim peripheral to the tray. The transition between alternate operative positions of the receptacle is facilitated by a fulcrum or pivot point between the primary base and the auxiliary base. A second embodiment of the invention differs from the first embodiment principally by providing for detachability of the tray from the receptacle.

15 Claims, 7 Drawing Figures

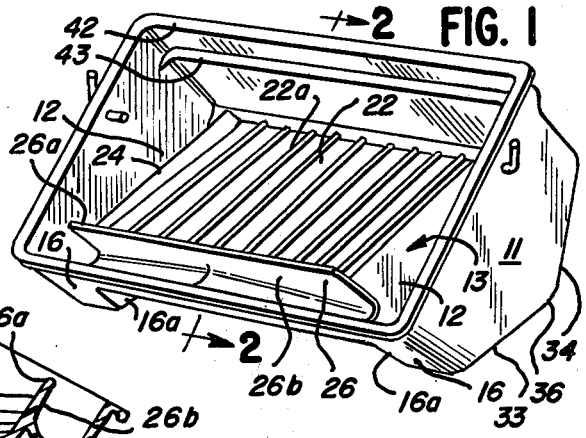
FIG. 1
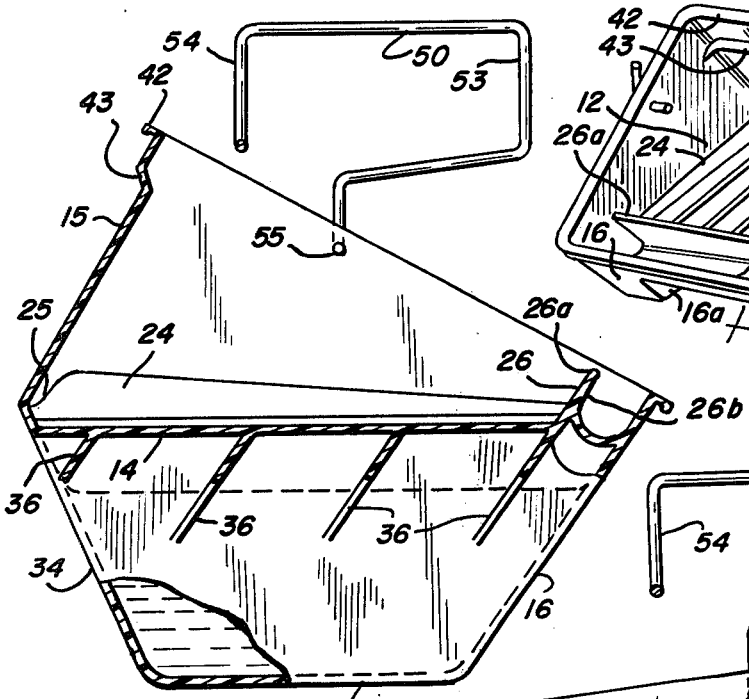
FIG. 2
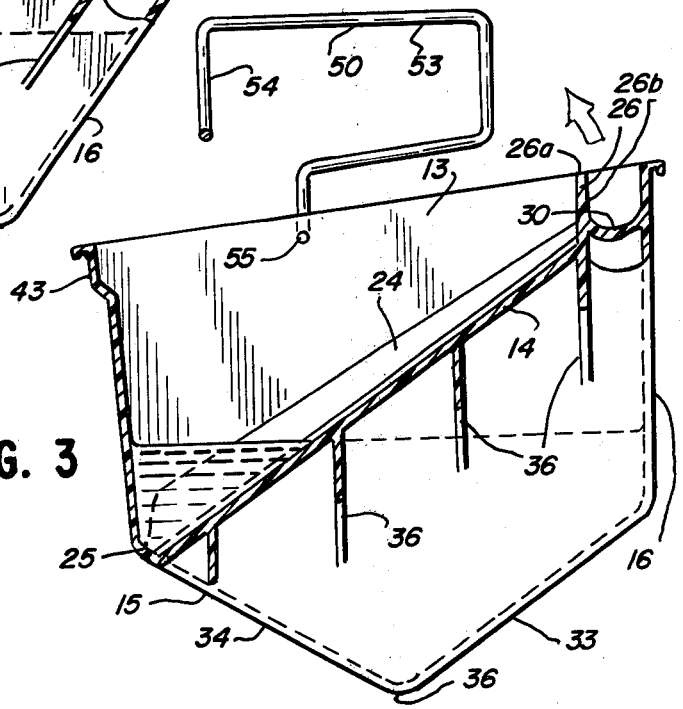
FIG. 3
FIG. 4
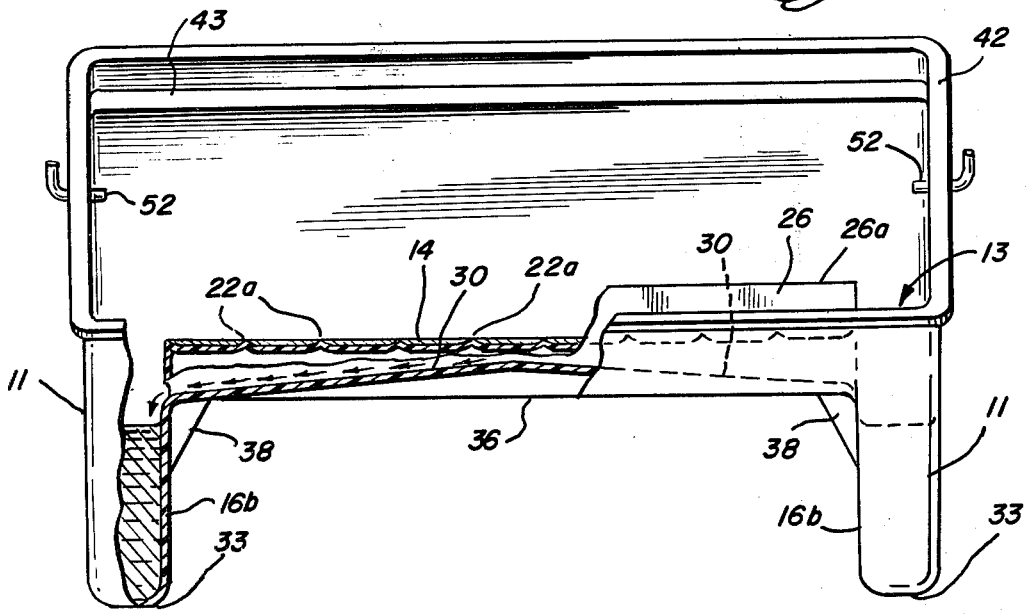

PAINT TRAY AND RESERVOIR

BACKGROUND OF THE INVENTION

This invention relates to a receptacle for receiving liquid particularly paint, stain and the like, in a quantity and at a level suitable for loading an applicator such as a paint pad with an appropriate amount of liquid for transferring and spreading such liquid upon a surface to be coated thereby. Similar purposes have long been served by relatively shallow open trays having troughs for accomodating a substantial supply of liquid and having normally slanted adjoining roll-out and draining surfaces and wiping walls or rims. U.S. Pat. No. 3,590,416, issued July 6, 1971 to Henningen, discloses a more advanced paint receptacle for storing a substantial supply of paint in a cylindrical reservoir having an open top and threadably attachable to the bottom of a tray in which an inlet passage and an excess drainage passage are provided and in which the supply of paint on the tray may be replenished by successive tilting and levelling of the combined reservoir and tray. The tray disclosed in U.S. Pat. No. 3,590,416, has certain disadvantages which are overcome by the present invention. In the prior art the time and effort of assembling and disassembling, the risk of spillage resulting from an imperfect seal between the reservoir and the tray, the relatively long time required by viscose paint to flow through the rather constricted passages between the tray and the reservoir, the risk of overloading the receptacle due to the user's inability to visually observe the liquid level in the reservoir during the process of filling the receptacle in its assembled condition, the difficulty of transferring paint remnants from the reservoir to the tray, the risk of clogging and the difficulty of unclogging the passageways, the risk of spillage due to the unstable position of the assembled unit when tilted to replenish the paint supply on the tray, and lack of convenient on-tray storage for manual painting tools such as brushes which in certain painting projects may be used as applicators in addition to paint pads.

The present invention provides a new and improved receptacle for liquid and particularly paint and the like, which overcomes these shortcomings and disadvantages by providing a receptacle in which both the reservoir and the tray are open toward the top for visual observance, for fast, convenient and direct input of liquid, and for removal of liquid from both the tray and the reservoir by a variety of applicator means. The receptacle of the invention is configurated to allow convenient storage of paint brushes alongside the tray and secure positioning of the receptacle with the tray in a generally horizontal position as well as secure positioning of the receptacle with the tray tilted for the purpose of replenishing the layer of paint thereon. The passageways between the reservoir and the tray are open toward the top so as to allow for rapid transfer of substantial quantities of liquid, to inhibit clogging and to facilitate visual observation of clogging and quick and convenient removal of clogging agents. In a first embodiment of the invention the receptacle is a unitary body so as to avoid spillage and other risks and difficulties associated with detachability of tray and reservoir and the seal between these two elements.

In a second embodiment of the invention the tray is removably attached to the reservoir and also incorporates the space below the tray as part of the reservoir. In this embodiment of the invention a perfect seal between the tray and the reservoir is not required to avoid spillage or other problems and difficulties associated with the prior art because the liquid retaining portion of the tray is positioned within the open reservoir. This embodiment also permits quick and convenient clean-up of the receptacle after use and provides most of the other advantages of the first embodiment of the invention.

Other objects, features and advantages of the present invention will become apparent from the following detailed description taken in conjunction with the accompanying drawings.

BRIEF DESCRIPTION OF THE DRAWINGS

FIG. 1 is a front perspective view of a liquid dispenser apparatus which embodies the features of the present invention;

FIG. 2 is a vertical cross-sectional view taken substantially along lines 2—2 of FIG. 1;

FIG. 3 is a cross-sectional view similar to FIG. 2 showing the dispenser apparatus in a tilted position for resupply of fluid from the reservoir to an applicator tray;

Figure 6:
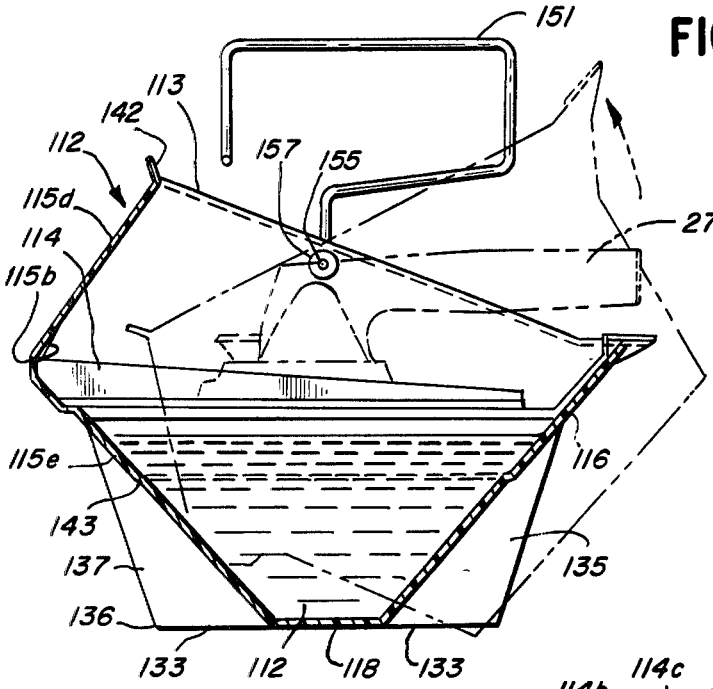
Figure 7:
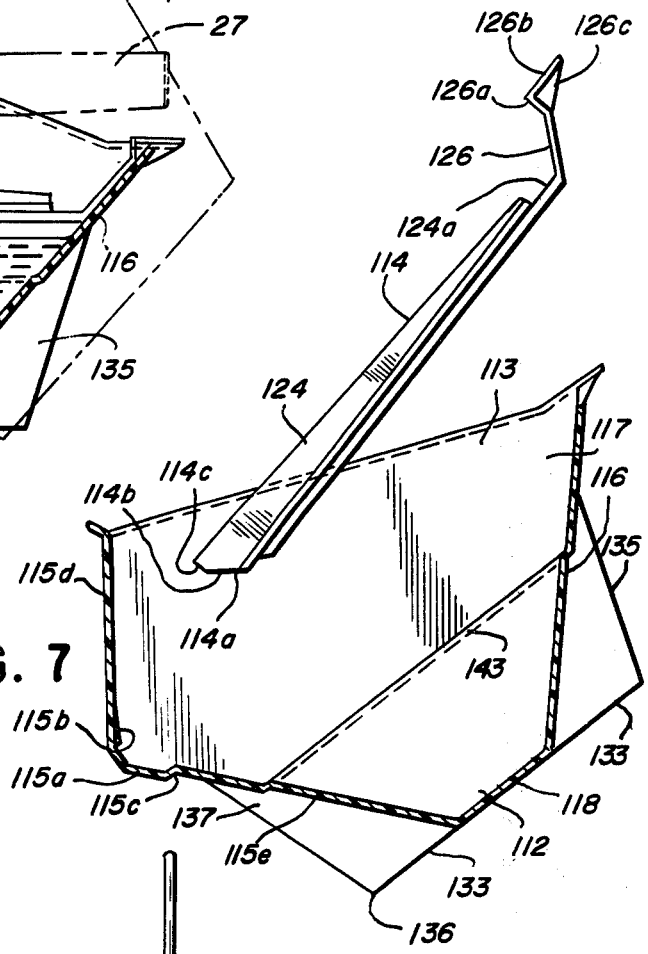
Figure 5:
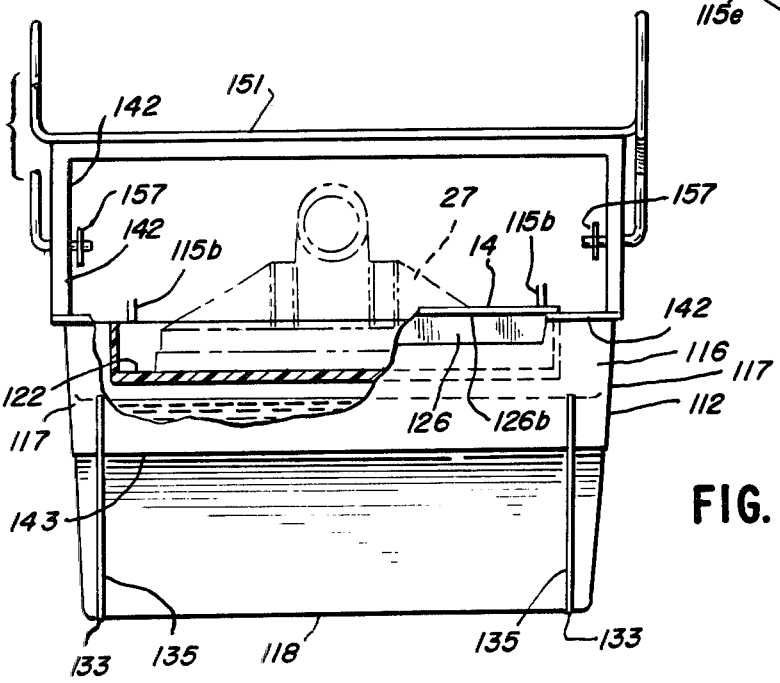

FIG, 4 is a front elevational view of the apparatus of FIG. 1 which portions broken away to provide a partial vertical sectional view;

FIG. 5 is a frontal elevational view of an alternate embodiment of a liquid dispenser apparatus in accordance with the present invention with portions broken away and in section and with an applicator pad on the tray;

FIG. 6 is a vertical cross-sectional view of the apparatus of FIG. 5 taken generally along lines 6—6 of FIG. 5 and illustrating the outline of the receptacle in a tilted position in dotted lines; and FIG. 7 is a cross-sectional view similar to the tilted position of FIG. 6 and showing the tray detached from the reservoir.

DESCRIPTION OF THE PREFERRED EMBODIMENTS

The apparatus or reservoir for storing and dispensing liquid generally designated 10 in FIG. 1, preferably has a molded unitary body including a pair of outer walls 11 defining a pair of hollow receptacles or reservoirs 12 each having an open upper end 13 for receiving a substantial quantity of liquid particularly paint or the like. The outer walls 11 are connected to a rear wall 15 and a pair of front walls 16. A generally level platform 14 entends horizontally from rear wall 15 into the interior of the receptacle between the front walls 16 to serve as a paint tray 14. A pair of inner end walls **16*a* complete the periphery of the device. In use, a relatively thin layer of paint is retained on tray 14 for pick-up by a manually operated applicator such as the paint pad 27 shown in FIG. 6. A plurality of shallow, parallel ridges 22*a* are provided on the top surface 22 of tray 14 for structural reinforcement and to aid in even distribution of the paint to the applicator. Opposite the rear wall 15, the tray 14 is bordered by an upwardly slanting wiping wall 26 which serves to retain liquid on tray 14 and allows the user to remove excess liquid from the applicator by drawing its oversaturated liquid pick-up means with suitable pressure over the top edge 26*a* of wiping wall 26. A pair of upstanding tray sidewalls 24 extend rearwardly along the sides of the tray from wiping wall 26 to rear wall 15 to retain liquid on the tray. The height of sidewalls 24 is reduced at their respective junctures with rear wall 15 and wiping wall 26 to provide passageways 25 for the drainage of excess liquid from the tray into the adjacent surrounding reservoir 12. The exposed front face 26***b* wiping wall 26 integrally connects with curved surface portion between the walls 16*b* to provide a gutter 30 which slopes laterally and downwardly from its approximate center to provide drainage of fluid from front face 26*b* of wiping wall 26 toward the paint reservoirs 12, which are secured to the sides of the tray 14. The reservoirs 12 extend substantially below tray 14 and are proportioned to accomodate the bulk of the liquid supply in the apparatus 10 during normal use. Portions of outer walls 11 constitute the exterior of reservoirs 12 and terminate in a horizontal pair of secure footings 33 which form the support base for receptacle 10 when it is in the first operative position as depicted in FIG. 2. Rearward portions of outer wall 11 terminate in a second pair of footings 34 which function as a secure auxiliary base when reservoir 12 is in a second operative position. At the juncture of footings 33 and 34 pivot points 36 are formed to permit the user to rock receptacle 10 from its first operative position (FIG. 2) in which tray 14 is in a generally horizontal position to the second operative position in which the liquid level on tray 14 merges with the liquid level in the remainder of the reservoir 10. A plurality of transverse, canted ribs 36 extend under tray 14 between the inner end walls 16A which form inside faces of deep pockets 32. The ribs 36 reinforce and rigidify the tray 14 and connect to the walls 16A by strengthening flanges 38. The strength of the apparatus and the convenience of using and carrying the apparatus is further enhanced by a continuous lip 42 projecting outwardly from the open periphery of the wall 11 at the open top and by an outward step 43 in rear wall 15 just below lip 42.

A handle, which may be of any shape, generally designated as 50 is provided to facilitate carrying of the receptacle 10 and for supporting it in a hanging and normally level position on a rung or utility platform of a ladder or other implement. The handle 50 is preferably made of preformed wire and includes a pair of inwardly extending terminal axles 52 and a pair of generally U-shaped jaws 53 adjacent to axles 52 and fitting over a utility platform or rung of a ladder. The end portions of jaws 53 remove from axles 52 are interconnected by bridge 54 having a depressed center 56 which may engage the rear portion of a rung or utility platform. Axles 52 are journalled in a pair of apertures 55 provided in outer wall 11 below lip 42 and above the center of gravity of receptacle 12.

Referring now more particlarly to FIGS. 5, 6 and 7, the second embodiment of the invention as shown therein is generally similar to the first embodiment described with reference to FIGS. 1–4. Only the features of the second embodiment which differ from the features of the first embodiment will be described in detail and the same reference numerals.

The detachability of tray 114 from receptacle 112 is the principle feature distinguishing the second embodiment from the first embodiment. A wiping wall 126 is provided with an upstanding extension 126*a* and a lip 126*b* connected by stabilizing flanges 126*c*. The lip 126*b* enhances the rigidity of tray 114 and facilitates its manual insertion and removal from receptacle 112 by the operator. The lateral extremities of lip 126*b* overlie and are supported by lip 142 which extends outwardly from the top of outer wall 111 but is discontinuous in the area of front wall 116 which abuts and supports wiping wall 126. At the end of tray 114 opposite wiping wall 126 a nosewall 114*a* rises upward from tray 114. Nosewall 114*a* has a lower portion 114*b* and a top portion 114*c* disposed at different angles toward the top surface 122 of tray 114 to fit snugly and detachably into a recess 115*a* provided in rear wall 115. A pair of vertical flanges 115*b* extend from the interior surface of rear wall 115 into receptacle 112 adjacent to the top of nosewall 114*a* to secure tray 114 against unintentional upward displacement. Recess 115*a* is provided with a ledge 115*c* which cooperates with the bottom 114*c* of nosewall 114*a* to support the rear edge of tray 114 from below. Sidewalls 124 extend from nosewall 114*a* above surface 122 toward siping wall 126 but are separated from wiping wall 126 by gaps 124*a* through which excess liquid may drain from tray 114'into receptacle 112.

Receptacle 112 at its upper end 113 is open and substantially wider in its lateral dimensions than tray 114 to facilitate input into, visual inspection of, and direct access to liquid in receptacle 112. Above recess 115*a* rear wall 115 has an upwardly and inwardly sloping hood 115*d* to void spillage and retain liquid within receptacle 112 particularly when the receptacle is pivoted into its second operative position as generally described with respect to the first embodiment of the invention. Front wall 116 slopes downwardly and inwardly and merges with a bottom wall 118 which in turn merges with an upwardly and outwardly sloping portion 115*c* of rear wall 115. Outer wall 111 also includes lateral walls 117. Receptacle 112 is further reinforced by angular step 143 along outer wall 111. A pair of triangular flanges 135 project outwardly from front wall 116 and a similar pair of triangular flanges 137 project outwardly from rear wall 115*c*. Both pairs of flanges extend downwardly slightly below the level of bottom wall 118 to form footings 133 securely supporting the apparatus in a first operative position.

The outward bottom corners of triangular flanges 137 provide pivot points 136 around which the apparatus may be tilted into a second operative position. In its second operative position receptacle 112 is securely supported on a level surface by the most prominent portion of rear wall 115 defining recess 115*a* and pivot points 136 which cooperate to form an auxiliary base for receptacle 112.

The configuration, attachment and function of handle 151 mounted in apertures 155 and optionally secured by retaining washers 157 are substantially identical to those described with reference to the first embodiment of the invention.

In operation of the apparatus 10, the tray 114 is placed into receptacle 112 by manually inserting nosewall 114*a* into recess 115*a* and seating wiping wall 126 against the top portion of front wall 116. Receptacle 112 is put into its second operative position and a suitable amount of liquid is poured into it. Upon placing receptacle 112 into its first operative position, tray 114 retains a relatively thin layer of liquid while most of the excess liquid drains through passageways 25 or gaps 124*a* into the reservoirs 12 or into the bottom portion of receptacle 112.

In both embodiments, a portion of the thin layer of paint remaining on the tray 14 or 114 may be conveniently picked up by a manual tool such as paint pad 27 or a paint roller or brush or the like. During the pick-up operation receptacle 10 or 112 is preferably in its first operative position standing on footings 33 or 133 or supported in a hanging position by handle 51 or 151. Applicator tools such as brushes may be placed and stored during the application process in reservoirs 12 or in the space provided in receptacle 112 between sidewalls 124 and lateral walls 117.

The supply of liquid on tray 14 or 114 is replenished by tilting receptacle 10 or 112 backwards so that the rear portion of tray 14 or 114 is submerged below the liquid level maintained in reservoirs 12 or in the bottom portion of receptacle 112. If the receptacle is in a standing position rearward tilting is conveniently accomplished by manually rocking receptacle 10 or 112 on pivot points 36 or 136 and placing it in its second operative position supported by auxiliary base 34, or by pivot points 136 in conjunction with the most prominent portion of rear wall 115. Upon return of receptacle 10 or 112 to its first operative position withdrawal of liquid from tray 14 or 114 may be resumed as described above. Alternating, when used in the hanging position, paint is supplied to the tray 14 or 114 by pivoting the device 10 about the axles 52 of the handle 50. Upon the termination of the application process liquid remnants are conveniently removed from all surfaces of receptacle 12 or 112 by rinsing and manual scrubbing, which is facilitated in the first embodiment by suitably dimensioning reservoirs 12 and in the second embodiment by the detachability of tray 114.

Although the present invention has been described with reference to several illustrative embodiments thereof, it should be understood that numerous other modifications and embodiments can be devised by those skilled in the art that will fall within the spirit and scope of the principles of this invention.

What is claimed as new and desired to be secured by Letters Patent is:

1. An apparatus for dispensing liquid to an applicator, comprising:

a plastic vessel having a first means for storing liquid and second means for dispensing liquid wherein said second means is a tray removably mounted in said apparatus, said vessel having an open upper end suitable for intake of liquid and for insertion of an applicator for picking up liquid from said second means;

a base supporting said vessel securely in a first operative position wherein said second means retains said liquid;

an auxiliary base securely supporting said vessel in a second operative position wherein said liquid is dispensed from said first means to said second means; and means including a fulcrum adjacent said base and said auxiliary base for selectively rocking said vessel into either of said operative positions.

2. The apparatus of claim 1 wherein said vessel has a rear wall forming a part of said auxiliary base.

3. The apparatus of claim 2 wherein said base and said auxiliary base join to form said fulcrum of said rocker means.

4. A paint tray and reservoir, comprisng:

a receptacle having a first and a second reservoir for storing and dispensing paint;

an open upper end on said receptacle suitable for intake of liquid and for insertion of an applicator for picking up liquid from said reservoirs;

a base supporting said receptacle securely in a first operative position;

an auxiliary base securely supporting said receptacle in a second operative position;

means including a fulcrum adjacent said base and said auxiliary base for selectively rocking said receptacle into either of said operative positions; and a tray in said receptacle disposed generally parallel to and above said base for retaining a predetermined amount of paint when said receptacle is in said first operative position, and for receiving a predetermined amount of paint when said receptacle is in said second operative position, said tray having an upwardly extending peripheral rim for retaining a predetermined amount of paint on the tray.

5. The apparatus of claim 4 wherein said tray is reinforced by a plurality of ribs integral with said tray.

6. The apparatus of claim 4 or 5 wherein a portion of said rim is a wiping wall for removing excess liquid from an applicator.

7. A paint tray comprising:

a receptacle having a reservoir of relatively large capacity for storing and dispensing liquid, said reservoir including a pair of lateral walls, a front and a rear wall connecting said lateral walls;

an open upper end on the receptacle suitable for intake of liquid and platform mounted in said receptacle wherein said platform is removable from said paint tray;

a base for supporting said receptacle securely in a first operative position;

an auxiliary base securely supporting said receptacle in a second operative position;

means including apivot point adjacent said base and said auxiliary base to permit selective manual pivoting of said receptacle to either of said operative positions; and the rear wall of said reservoir includng an upper portion extending above and inwardly of said platform when said apparatus is in its first operative position and defining the highest level of liquid in said apparatus when said apparatus is in its second operative position.

8. The apparatus of claim 7 wherein said reservoir includes a pair of laterally spaced sub-reservoirs adjacent said platform and extending to a lower level than said platform when said apparatus is in its first operative position.

9. Apparatus for dispensing liquid for pick-up by an applicator comprising:

a first reservoir and a tray for storing and dispensing paint having a plurality of opposing walls;

said reservoir having an open upper end suitable for intake of liquid and for insertion of an applicator for picking up liquid;

said reservoir and said tray including interfitting mounting means for detachably mounting said tray above said reservoir;

a base supporting said reservoir securely in a first operative position wherein said tray retains said liquid;

an auxiliary base securely supporting said tray and said reservoir in a second operative position wherein said liquid is dispensed from said reservoir into said tray;

rocker means including a pivot point adjacent said base and said auxiliary base for selectively rocking said apparatus into either of said operative positions.

10. The apparatus of claim 9 wherein said mounting means include first mounting means on said tray and second mounting means on opposed walls of said reservoir to engage said first mounting means to support said tray within said reservoir.

11. The apparatus of claim 9 wherein said tray has opposed upstanding walls configurated to interfit with correspondingly configurated opposed walls of said reservoir.

12. The apparatus of claim 9, 10 or 11 wherein said tray includes a plurality of upstandng walls along its periphery and having drainage passages defind by said walls.

13. The apparatus of claim 9, 10 or 11 wherein said reservoir has a bottom wall, and said tray is supported above the bottom wall of said reservoir.

14. The apparatus of claim 9, 10 or 11 wherein said opposing walls of said reservoir include a pair of lateral walls spaced from said tray.

15. The paint tray and reservoir claimed in claim 4 wherein said tray is removably mounted in said receptacle.

* * * * *